US006863154B2

(12) United States Patent
Uegane et al.

(10) Patent No.: US 6,863,154 B2
(45) Date of Patent: Mar. 8, 2005

(54) VIBRATION ABSORBING APPARATUS FOR EXHAUST SYSTEM OF ENGINE

(75) Inventors: Masayuki Uegane, Saitama (JP); Kenji Kozaki, Saitama (JP); Yoshihiko Eguchi, Saitama (JP); Masamichi Fujishiro, Saitama (JP); Masahiko Higuchi, Saitama (JP); Hidenori Suzuki, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/171,408

(22) Filed: Jun. 13, 2002

(65) Prior Publication Data

US 2003/0057013 A1 Mar. 27, 2003

(30) Foreign Application Priority Data

Jun. 13, 2001 (JP) ..... P. 2001-178381

(51) Int. Cl.[7] ..... F16F 15/00; F16F 7/00; F01N 7/08; E21F 17/02; F16L 3/00

(52) U.S. Cl. ..... 181/207; 181/227; 181/228; 248/58; 248/68

(58) Field of Search ..... 180/296, 309, 180/89.2; 248/610, 58, 60; 181/207, 208, 227, 228, 232, 240

(56) References Cited

U.S. PATENT DOCUMENTS

| | | | | | |
|---|---|---|---|---|---|
| 3,270,992 | A | * | 9/1966 | Cassel | 248/60 |
| 3,942,599 | A | * | 3/1976 | Shimada | 180/292 |
| 4,550,795 | A | | 11/1985 | Teshima | |
| 4,659,117 | A | * | 4/1987 | Holzhausen et al. | 285/49 |
| 4,676,332 | A | * | 6/1987 | Saito | 180/89.2 |
| 4,893,778 | A | * | 1/1990 | Drabing et al. | 248/610 |
| 4,928,998 | A | * | 5/1990 | Brandener | 285/49 |
| 5,069,306 | A | * | 12/1991 | Inoue et al. | 180/291 |
| 5,251,720 | A | * | 10/1993 | Hasetoh et al. | 180/297 |
| 5,323,989 | A | * | 6/1994 | Hamada et al. | 248/60 |
| 5,340,165 | A | * | 8/1994 | Sheppard | 285/226 |
| 5,445,241 | A | * | 8/1995 | Nakamura et al. | 180/296 |
| 5,673,877 | A | * | 10/1997 | Karner et al. | 248/58 |
| 5,779,282 | A | * | 7/1998 | Ezze | 285/261 |
| 5,966,932 | A | | 10/1999 | Yahagi | |
| 6,260,652 | B1 | * | 7/2001 | Steenackers et al. | 180/296 |
| 6,312,022 | B1 | * | 11/2001 | Brophy et al. | 285/268 |
| 6,415,603 | B1 | * | 7/2002 | Nowka et al. | 60/322 |

FOREIGN PATENT DOCUMENTS

| | | | | |
|---|---|---|---|---|
| JP | 2-76120 | | 6/1990 | |
| JP | 4-105931 | | 9/1992 | |
| JP | 6-12985 | | 4/1994 | |
| JP | 2002371841 | A * | 12/2002 | F01N/7/08 |
| WO | WO 93/04270 | | 3/1993 | |

* cited by examiner

*Primary Examiner*—Kimberly Lockett
*Assistant Examiner*—Patrick Miller
(74) *Attorney, Agent, or Firm*—Carrier, Blackman & Associates, P.C.; Joseph P. Carrier; William D. Blackman

(57) ABSTRACT

An exhaust manifold 14 extending downwardly is connected to a rear side of a transversely disposed engine E. A primary exhaust pipe portion 16 is connected to the exhaust manifold 14 via a spherical joint 18 provided close to the engine E. Furthermore, a secondary exhaust pipe portion 17 is connected to the primary exhaust pipe portion 16. In the primary exhaust pipe portion 17, a flexible tube 19 is disposed at a position upstream of a support portion to the vehicle body.

18 Claims, 6 Drawing Sheets

VIBRATION ABSORBING APPARATUS FOR EXHAUST SYSTEM OF ENGINE

BACKGROUND OF THE INVENTION

1. Field of the Invention

The present invention relates to a vibration absorbing apparatus for an exhaust system of an engine in which exhaust system having an exhaust manifold that extends downwardly relative to an engine arranged transversely in a vehicle body (so called as a transverse engine having a crank shaft extending in a direction substantially perpendicular to a front-rear direction of the vehicle body) and is connected to exhaust ports opened in a rear side of the engine and also connected to an exhaust pipe.

2. Discussion of Relevant Art

Conventionally, in a vehicle having the transverse engine, an exhaust system connected to exhaust ports of the engine is supported on a vehicle body via a resilient support member. Additionally, there has been known a vibration absorbing apparatus for the exhaust system in which a vibration absorbing structure such as a flexible tube and/or a spherical joint is connected to the exhaust system at an intermediate position in the longitudinal direction thereof so as to dampen rolling vibrations around a rolling center of the engine which is substantially parallel to an axis of the crankshaft thereof, thereby making it difficult for the vibrations to be transmitted to the vehicle body (for example, refer to Japanese Utility Model Examined Publication No. Hci.6-12985 (JP-B-6-12985U).

Incidentally, in a vehicle in which an exhaust system is disposed to be connected to a front side of the engine which is transversely installed in a body of the vehicle, since the exhaust system passes under the engine to extend to the rear of the vehicle body, the flexible tube can be disposed relatively close to the rolling center of the engine. Accordingly, the transmission of rolling vibrations of the engine to the exhaust system can be effectively dampened through extension and contraction of the flexible tube.

On the other hand, in a case where the exhaust system is disposed on a rear side of the transversely installed engine, since the exhaust system does not pass under the engine, the flexible tube has to be disposed at the rear of the engine and is hence placed far apart from the rolling center of the engine. Consequently, the displacement of the flexible tube per unit rolling angle of the engine increases, and as a result, there is caused a problem that the durability of the flexible tube is reduced and also the expected vibration dampening effect cannot be achieved. In addition, in order to solve this problem, the expensive flexible tube has to be longer, this causing another problem that the production cost has to be remarkably increased.

SUMMARY OF THE INVENTION

The invention was made in these situations. It is an object of the present invention to provide a novel vibration absorbing apparatus for an exhaust system of an engine which is disposed rearward of the engine.

In the present invention, both a spherical joint and a flexible tube are provided along the exhaust system so as to solve the problems through a synergistic effect of using them together.

The object can be achieved by an aspect of the invention, according to which there is provided a vibration absorbing apparatus for an exhaust system of an engine in which an exhaust manifold extending downwardly relative to an engine arranged transversely in a vehicle body is connected to exhaust ports opened in a rear side of the engine and an exhaust pipe is connected to the exhaust manifold. The exhaust pipe comprises a primary exhaust pipe portion and a secondary exhaust pipe portion. The primary exhaust pipe portion is connected to a downstream end of the exhaust manifold. The primary exhaust pipe portion has a curved portion and extends downward and rearward of the engine. The secondary exhaust pipe portion is connected to the primary exhaust pipe portion and extends rearward. In the vibration absorbing apparatus, a spherical joint is disposed between the downstream end of the exhaust manifold and an upstream end of the primary exhaust pipe portion in such a manner as to be provided close to the engine. In addition, in the apparatus, the secondary exhaust pipe portion comprises a support portion for supporting the exhaust pipe on a vehicle body side, and also a flexible tube is disposed upstream of the support portion.

Accordingly, when the engine largely rolls to be displaced due to the abrupt start or deceleration of a vehicle it is ensured that this large rolling displacement is absorbed by the spherical joint so that the rolling displacement is not transmitted to the flexible tube, whereby the length of the flexible tube can be set to such a short length as to absorb mainly longitudinal vibrating displacements that occur while the vehicle runs normally. Accordingly, it is possible to absorb effectively vibrations caused by the rolling displacement of the engine generally through the synergistic effect of the adoption of the spherical joint and the flexible tube, and the vibration of the vehicle body attributed to the vibrations caused by the engine rolling displacement can be thus reduced as much as possible. Additionally, the weight and cost of the entirety of the exhaust system can be reduced as a result of reduction in the length of the flexible tube, and moreover, the durability of the flexible tube can be increased.

DETAILED DESCRIPTION OF THE PREFERRED EMBODIMENT

A preferred embodiment of the present invention will be described below based on an embodiment of the invention illustrated in the accompanying drawings.

Figure 3:
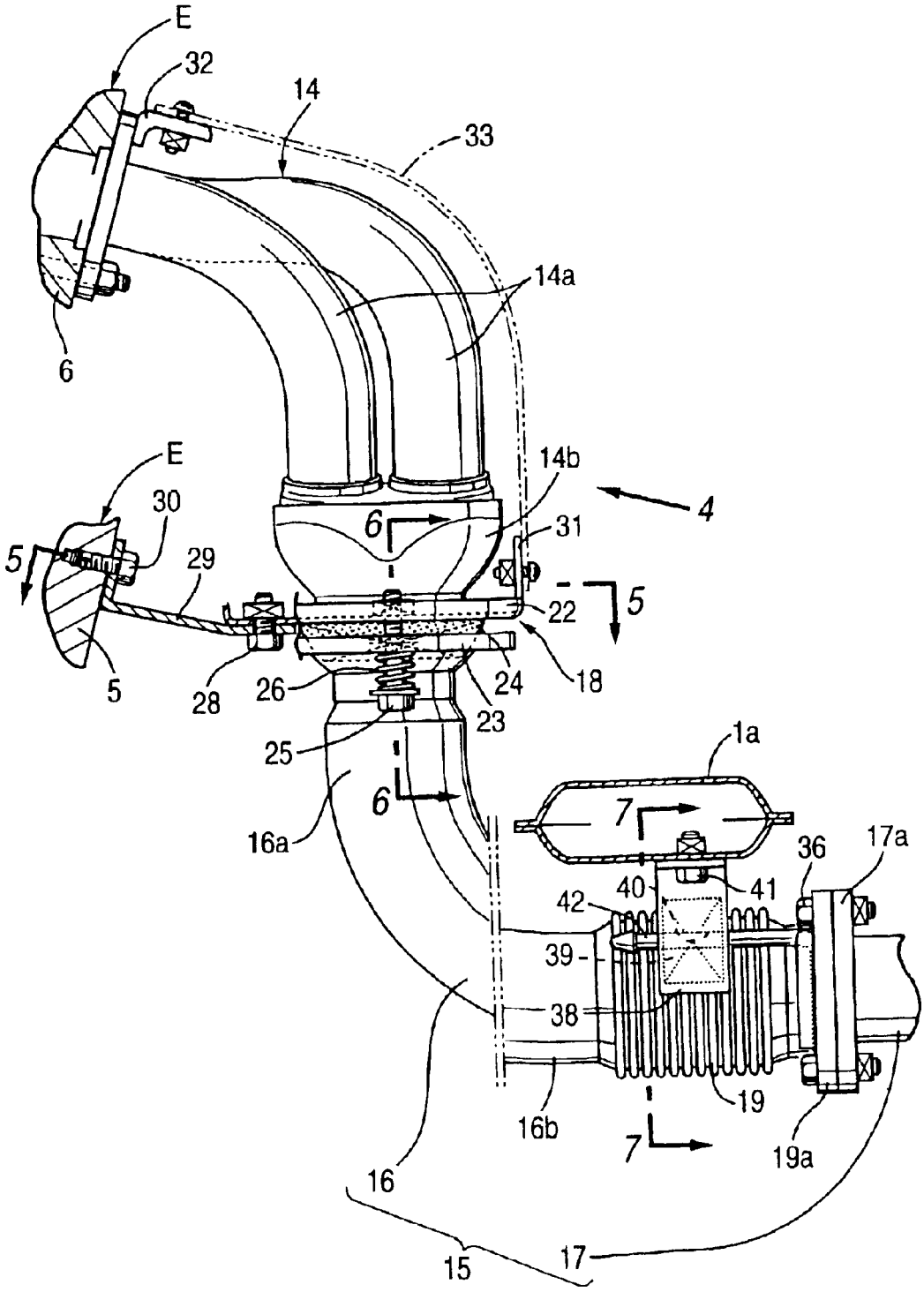
FIG. 3 shows an enlarged view of a portion of FIG. 2.
Figure 4:
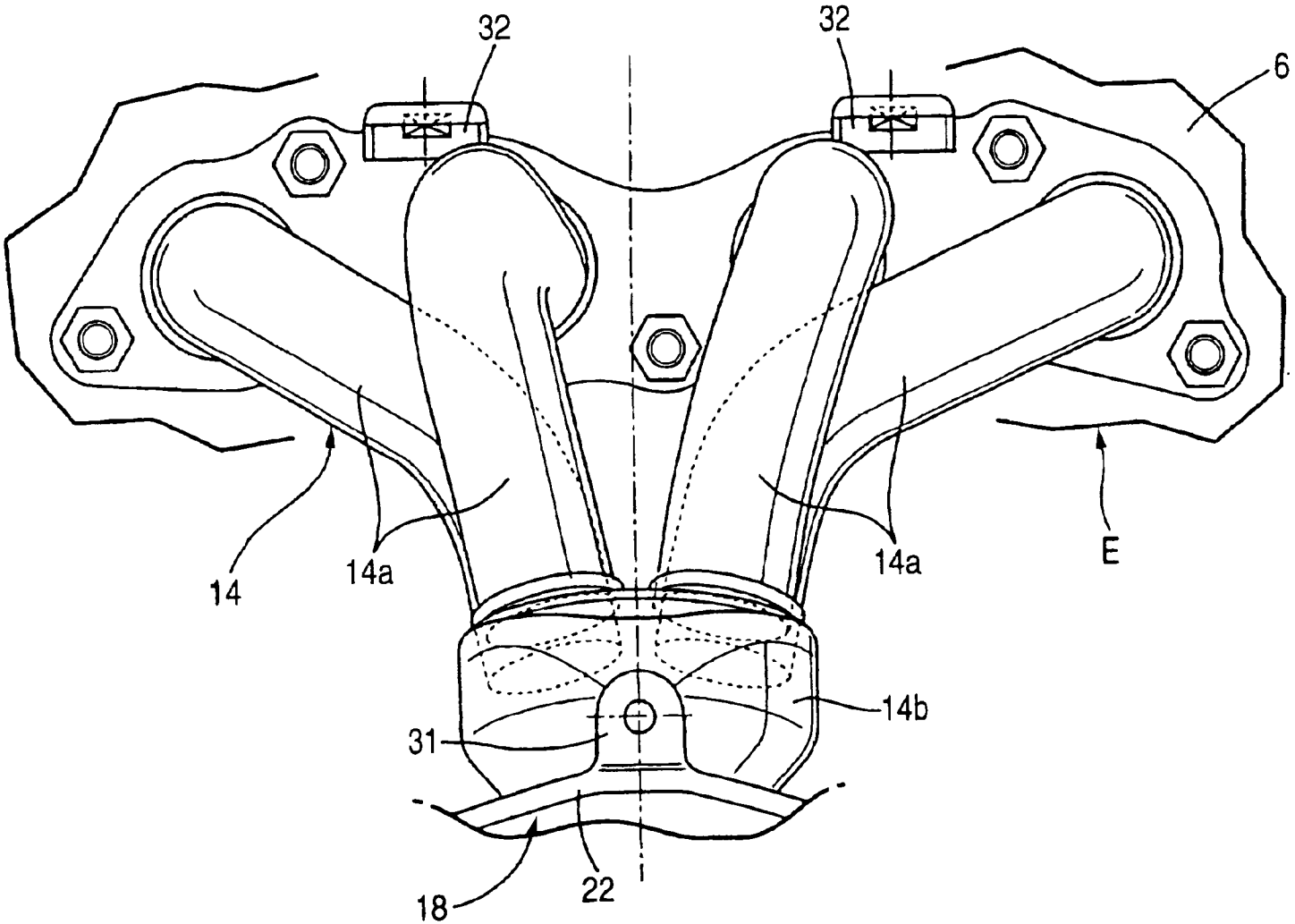
FIG. 4 shows a view of a portion of FIG. 3 as viewed in a direction indicated by an arrow 4 therein.
Figure 5:
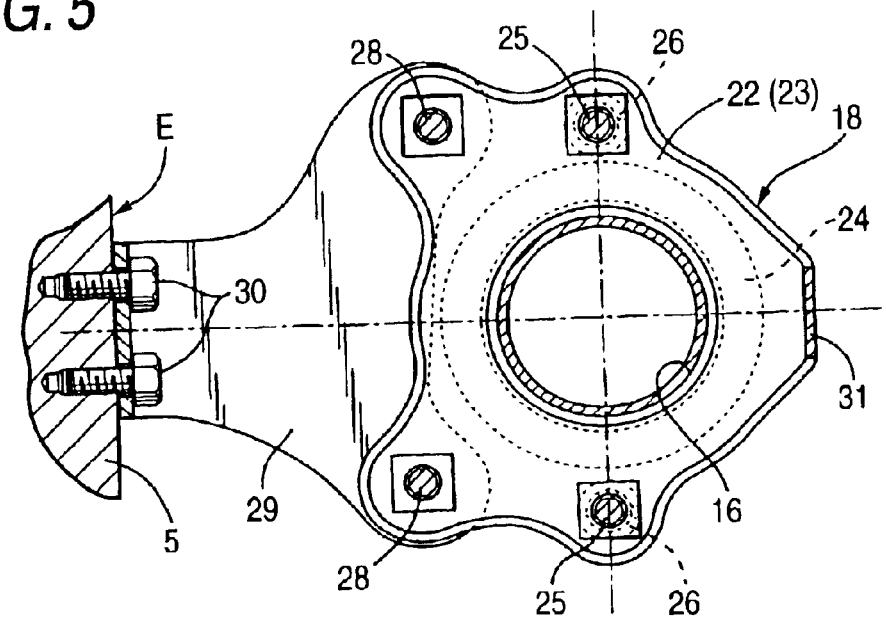
FIG. 5 shows a sectional view taken along the line 5—5 in FIG. 3.
Figure 6:
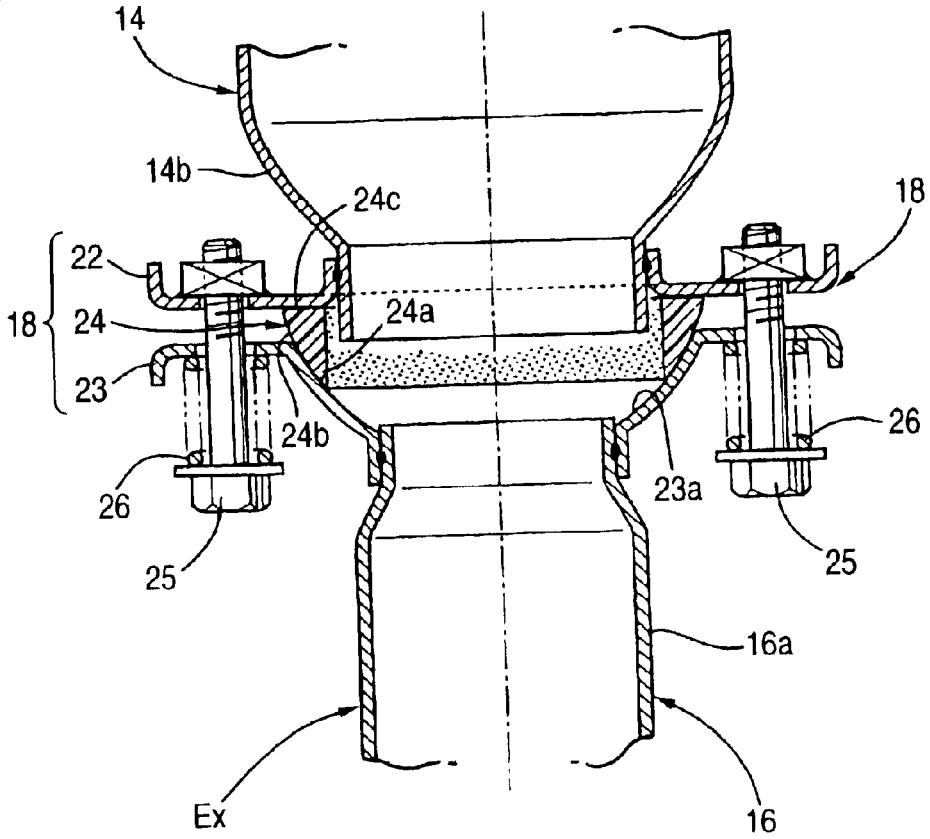
FIG. 6 shows a sectional view taken along the line 6—6 in FIG. 3.
Figure 7:
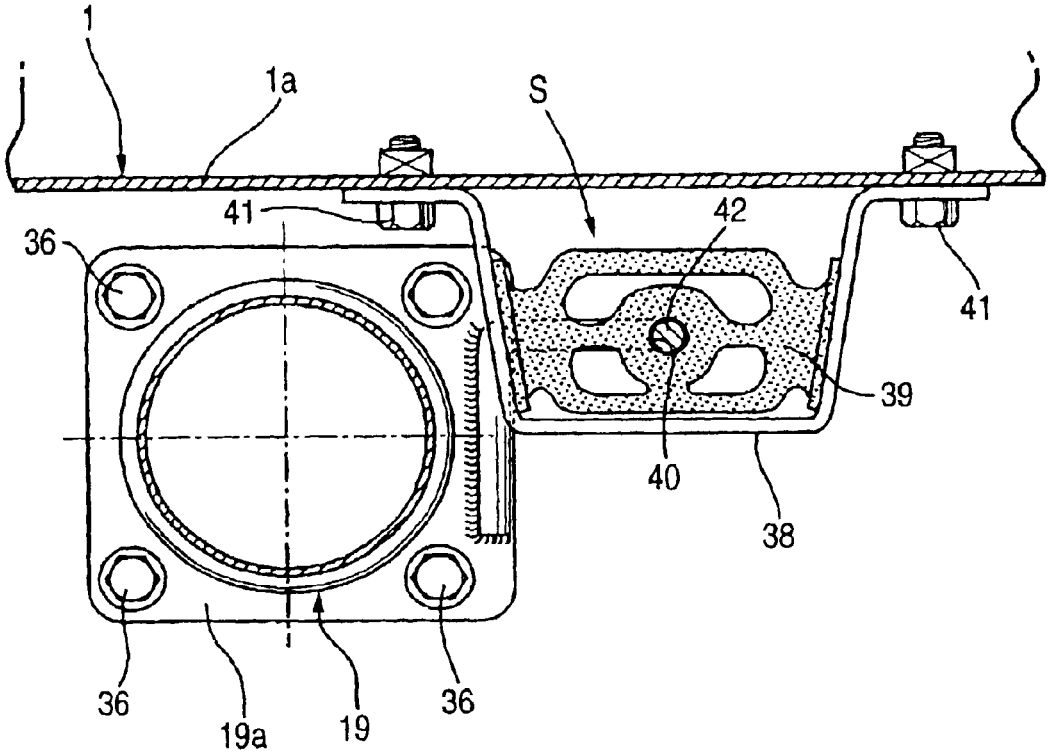
FIG. 7 shows a sectional view taken along the line 7—7 in FIG. 3.

This is an embodiment in which the invention is applied to a vehicle provided with an in-line four-cylinder engine. FIG. I shows a plan view of a vibration absorbing apparatus according to the invention used in an exhaust system of the engine. FIG. 2 is an enlarged view of a portion of FIG. 1 as viewed from a direction indicated by an arrow 2 therein. FIG. 3 is an enlarged view of a portion of FIG. 2. FIG. 4 is a view of a portion of FIG. 3 as viewed in a direction indicated by an arrow 4 therein. FIG. 5 is a sectional view taken along the line 5—5 in FIG. 3. FIG. 6 is a sectional view taken along the line 6—6 in FIG. 3, and FIG. 7 is a sectional view taken along the line 7—7 in FIG. 3.

Figure 1:
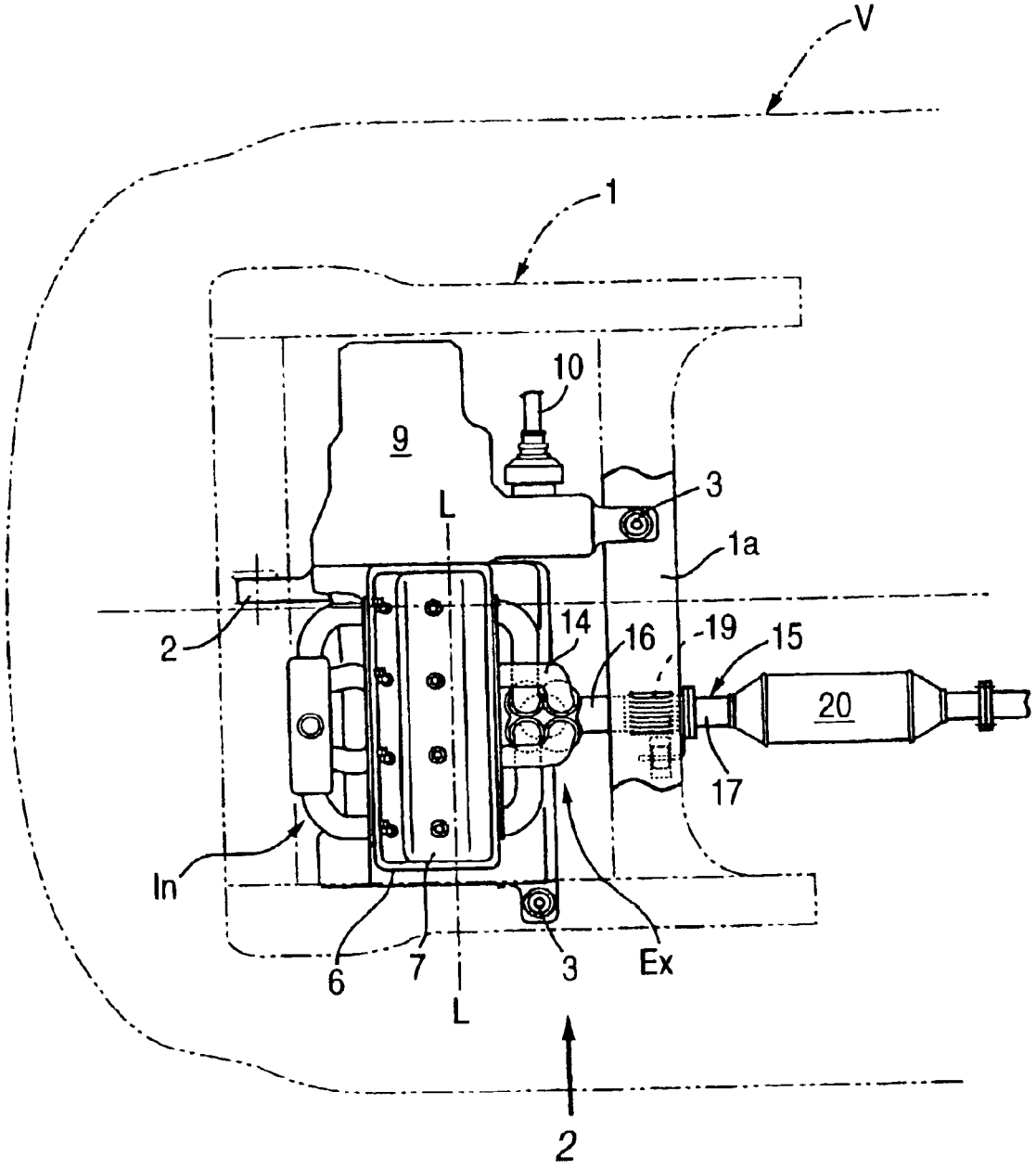
FIG. 1 shows a plan view of a vibration absorbing apparatus used in an exhaust system of an engine E.
Figure 2:
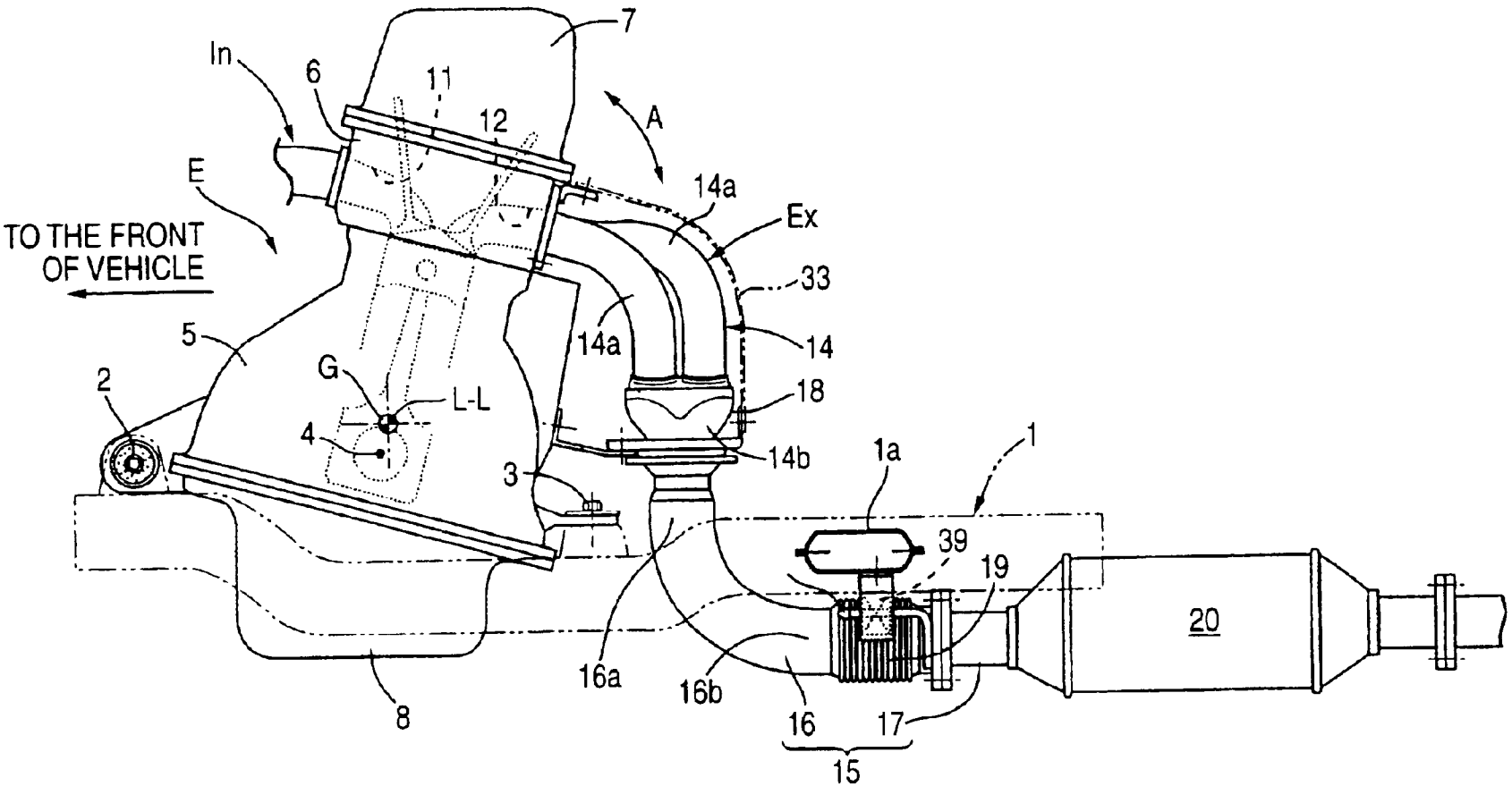
FIG. 2 shows an enlarged view of a portion of FIG. 1 as viewed from a direction indicated by an arrow 2 therein.

In FIGS. 1 and 2, an engine E for use in driving a vehicle V is transversely installed on a sub-frame constituting a part of a body of the vehicle V via front and rear engine mounts 2, 3. (Note that the engine E is installed in the vehicle in such a manner that an axis direction of a crankshaft 4 of the engine E intersects at right angle with a longitudinal direction of the vehicle V.)

This engine is a four-cycle in-line four-cylinder engine. The engine comprises a cylinder block 5 in which four cylinders are arranged in parallel, a cylinder head 6 joined onto the cylinder block 5, a cam cover 7 covering an upper side of the cylinder head 6 and an oil pan 8 joined to a lower side of a crank case portion of the cylinder block 5. Then, a transmission 9 is connected to one end of the engine E in the crankshaft 4 direction, and an output shaft 10 of the transmission 9 is connected to left and right drive wheels of the vehicle V via a power transmitting mechanism, not shown.

As shown in FIG. 2, the engine E has a vibrating rotational axis or a rolling axis L—L which passes the center of gravity G and is in parallel with the crankshaft 4, and while the vehicle V is driven the engine E rolls to be displaced in the longitudinal directions about the rolling axis L—L as a rolling center.

Four intake ports 11 are opened in parallel in a front side (a left-hand side as viewed in FIGS. 1 and 2) of the engine E, and an intake system In is connected to these intake ports 11. In addition, four exhaust ports 12 are opened in parallel in a rear side (a right-hand side as viewed in FIG. 1) of the engine E, and an exhaust system Ex is connected to these exhaust ports 12.

The exhaust system Ex comprises an exhaust manifold 14 integrally connected to the exhaust ports 12 at an upstream end thereof and an exhaust pipe 15 connected to a downstream end of the exhaust manifold 14. The exhaust pipe 15 comprises a primary exhaust pipe portion 16 which is disposed on the upstream side and a secondary exhaust pipe portion 17 which is disposed on the downstream side.

Additionally, a spherical joint 18 is interposed between the exhaust manifold 14 and the primary exhaust pipe portion 16, and a flexible tube 19 is interposed between the primary exhaust pipe portion 16 and the secondary exhaust pipe portion 17. Furthermore, a catalytic converter 20 is interposed at an intermediate position along the length of the secondary exhaust pipe portion 17.

Incidentally, this exhaust system Ex is designed to effectively absorb rolling displacement of the engine E which occurs when the engine E largely rolls to vibrate or to be displaced while the vehicle is running, in particular, when the vehicle abruptly starts, accelerates or decelerates to thereby reduce as much as possible the vibration of the vehicle caused by the rolling displacement of the engine E.

The exhaust system Ex of the embodiment according to the present invention will be described in greater detail below.

As clearly shown in FIGS. 3 and 4, four branch pipes 14*a* of the exhaust manifold 14 are curved so as to be connected, respectively, to the associated exhaust ports 12 of the engine E at upstream ends thereof and extend downwardly along the rear side of the engine E while gradually converging. Downstream ends of the branch pipes are made to open downwardly and are integrally connected to a single exhaust collecting portion 14*b*. This exhaust collecting portion 14*b* is, as shown in FIG. 2, connected to an upstream end of the primary exhaust pipe portion 16 via the spherical joint 18 at a position close to the rear side of the engine E.

As shown in FIGS. 5 and 6, the spherical joint 18 comprises a first connecting flange 22 which constitutes one of joint halves, a second connecting flange 23 which constitutes the other joint half and a gasket 24 which is airtightly held between the two flanges 22, 23. The gasket 24 is made from a heat-resistant material such as carbon, has in the center thereof an opening 24*a* for passage of exhaust gases and has on one side thereof a spherical portion 24*b* which surrounds the opening 24*a*. The gasket 24 is brought into contact with the first connecting flange 22 on the other side 24*c* thereof which is made flat. Additionally, the spherical portion 24*b* is brought into slidable contact with a spherical seat 23*a* formed on the second connecting flange 23. The first and second connecting flanges 22, 23 are coupled together in a springing fashion via a spring 26 with a plurality of bolts and nuts 25.

As is clearly shown in FIG. 6, the exhaust collecting portion 14*b* of the exhaust manifold 14 is integrally inserted into a central portion of the first connecting flange 22 which constitutes the one joint half (the upper joint half as viewed in FIGS. 2 and 3) of the spherical joint 18 for communication therewith, and the upwardly opened upstream end of the primary exhaust pipe portion 16 is integrally inserted into a central portion of the second connecting flange 23 which constitutes the other (or lower as viewed in FIG. 3) joint half of the spherical joint 18 for communication therewith. Consequently, exhaust gases which flow through the exhaust manifold 14 pass through the spherical joint 18 to flow into the primary exhaust pipe portion 16.

As shown in FIGS. 2, 3 and 5, a stay 29 is fixed to the one joint half which is connected to the exhaust manifold 14 side, i.e., the first connecting flange 22, with a plurality of bolts and nuts 28. This stay 29 extends to the front toward the rear side of the engine E and is fixed to the rear side of the cylinder block 5 of the engine E at a bent mounting portion at a distal end thereof. Consequently, when the engine E rolls to be displaced around the rolling axis L—L the other joint half 23 rotates to be displaced relative to the one joint half 22 via the gasket 24.

As shown in FIGS. 3 and 4, one mounting piece 31 is formed to erect from a side of the one joint half 22 which is apart from the engine E and two mounting pieces 32 are fixed to the engine E side mounting portion of the exhaust manifold 14, whereby an exhaust manifold cover 33 for covering the exterior of the exhaust manifold 14 is supported at those three support points which exhaust manifold cover is indicated by double-dashed lines in FIGS. 2 and 3.

As has been described above, as is shown in FIGS. 1, 2, the primary exhaust pipe portion 16 which is connected to the spherical joint 18 at the upstream end thereof has a curved portion which curves in a convex fashion toward the engine E side. An upstream-side half portion 16*a* extends downwardly relative to the engine E and a downstream-side half portion 16*b* extends to the rear relative to the engine E, whereby the curved portion is formed into an elbow-like configuration as viewed from the side thereof. Then, a front end of the flexible tube 19 is connected to a downstream end of the primary exhaust pipe portion 16 which is made to open to the rear for communication therewith. This flexible tube 19 is constructed to be shorter owing to the existence of the spherical joint 18 and extends in the longitudinal direction. The flexible tube 19 is adapted to extend and contract in the longitudinal directions so as to absorb mainly longitudinal components of the rolling displacement of the engine E.

Note that since a conventional flexible tube is adopted for the flexible tube 19, the detailed description thereof will be omitted herein.

A downstream end of the flexible tube 19 is made to open to the rear, and a connecting flange 17*a* formed at an upstream end of the secondary exhaust pipe portion 17 of the exhaust pipe 15 is integrally joined to a connecting flange 19*a* formed at the opened downstream end of the flexible tube 19 with a plurality of bolts and nuts 36, whereby a communication is established through the primary exhaust pipe portion 16, the secondary exhaust pipe portion 17 and the flexible tube 19.

The secondary exhaust pipe portion 17 extends substantially horizontally in the longitudinal direction of the vehicle V, and a catalytic converter 20 is connected to the secondary exhaust pipe portion 17 at an intermediate portion along the length thereof. Furthermore, a tail pipe which is made to open to the atmosphere is connected to a downstream end of the secondary exhaust pipe portion 17 via a muffler, not shown for communication therewith.

As shown in FIGS. 2, 3 and 7, a connecting portion between the flexible tube 19 and the secondary exhaust pipe portion 17 is supported on the body of the vehicle V via a resilient support structure S. Namely, fixedly secured with bolt and nut 41 to a cross member 1*a* of the sub-frame 1 which is part of the vehicle body for support thereon is a support plate 38 on which a damper block 39 made of a resilient body such as rubber, and a support hole 40 is opened in a central portion of the damper block 39 in such a manner as to extend therethrough in the longitudinal direction. On the other hand, a support portion 42 constituted by a rod which is bent into an angle-like shape is fixed to the connecting flange 19*a* of the flexible tube 19, and a substantially horizontal free end portion of the support portion 42 is allowed to extend through the support hole 40 for support therein in such a manner as to be freely drawn out of or inserted into the support hole 40. As shown, the rod 42 extends substantially parallel to the longitudinal axis of said flexible tube 19 and the damper block 39 is disposed adjacent to an intermediate portion of the flexible tube. Consequently, vibrations acting on the exhaust system Ex are also dampened by the resilient support structure S, whereby the vibrations are made more difficult to be transmitted to the vehicle V.

Next, the function of the embodiment will be described.

Exhaust gases being now produced by the operating engine E pass through the exhaust manifold 14, the spherical joint 18, the primary exhaust pipe portion 16, the flexible tube 19, the upstream portion of the secondary exhaust pipe portion 17, the catalytic converter 20, the downstream portion of the secondary exhaust pipe portion 17 and the muffler, not shown, and during the passage harmful components of the exhaust gases such as HC, CO and the like are purified and further the exhaust noise is muffled before the exhaust gases are allowed to be discharged to the atmosphere.

Incidentally, while the engine E largely rolls to be displaced around the rolling axis L—L as the rolling center as shown by an arrow A in FIG. 2 while the vehicle V is running, in particular, when the vehicle abruptly starts, accelerates or decelerates, this rolling displacement of the engine E is effectively absorbed by virtue of the rotational displacement of the other joint half 23 of the spherical joint 18 relative to the one joint half 22 (made integral with the engine E). In other words, since the spherical joint 18 is disposed between the exhaust manifold 14 and the primary portion 16 of the exhaust pipe 15 at the position close to the engine E, this allows the spherical joint 18 to be disposed as close to the rolling axis L—L of the engine E as possible, whereby as has been described above, even when the engine E largely rolls to be displaced around the rolling axis L—L it is ensured that the large rolling displacement of the engine E can be absorbed by virtue of the small rotational displacement of the spherical joint 18, whereby the rolling displacement is prevented from being transmitted to the flexible tube 19. Consequently, the length of the flexible tube 19 can be set to such a relatively short length as to absorb only the longitudinal components of the rolling displacement of the engine E which is caused by the running vehicle, whereby not only can the weight of the entirety of the exhaust system Ex be reduced but also the reduction in the production cost of the entirety of the exhaust system Ex can be attained by the reduction in length of the expensive flexible tube 19. For example, as shown in FIG. 2, the length of the flexible tube 19 is less than a width of the catalytic converter at its widest point. In addition, the reduction in length of the flexible tube can contribute to the extension of durability thereof.

Thus, while the embodiment of the invention has been described heretofore, the invention is not limited to the embodiment so described, and various embodiments can be provided without departing from the scope and spirit of the invention.

For example, while the embodiment describes the case where the vibration absorbing apparatus in the exhaust system according to the invention is applied to the in-line four-cylinder four-cycle engine, it goes without saying that the vibration absorbing apparatus of the invention can be applied to any other types of engines.

Thus, according to the invention, there is provided the vibration absorbing apparatus in the exhaust system of the engine in which the exhaust manifold extending downwardly relative to the engine arranged transversely in the body of the vehicle is connected to the exhaust ports opened in the rear side of the engine and the exhaust pipe is connected to the exhaust manifold, and according to the construction thereof, when the engine largely rolls to be displaced due to the abrupt start or deceleration of a vehicle it is ensured that this large rolling displacement is absorbed by the spherical joint, so that the rolling displacement is not transmitted to the flexible tube, whereby the length of the flexible tube can be set to such a short length as to absorb mainly longitudinal vibrating displacements that occur while the vehicle runs normally. Accordingly, it is possible to absorb effectively vibrations caused by the rolling displacement of the engine generally through the synergistic effect of the adoption of the spherical joint and the flexible tube, the vibration of the vehicle body attributed to the vibrations caused by the engine rolling displacement being thus reduced as much as possible. Additionally, the weight and cost of the entirety of the exhaust system can be reduced as a result of reduction in the length of the flexible tube, and moreover, the durability of the flexible tube can be increased.

While there has been described in connection with the preferred embodiment of the invention, it will be obvious to those skilled in the art that various changes and modifications may be made therein without departing from the invention, and it is aimed, therefore, to cover in the appended claim all such changes and modifications as fall within the true spirit and scope of the invention.

What is claimed is:

1. A vibration absorbing apparatus for an exhaust system of an engine arranged transversely in a vehicle body, wherein said exhaust system includes, an exhaust manifold extending downwardly relative to the engine and connected to exhaust ports opened in a rear side of said engine, and an exhaust pipe connected to said exhaust manifold, and comprising a primary exhaust pipe portion and a secondary exhaust pipe portion, wherein the primary exhaust pipe portion is connected to a downstream end of said exhaust manifold, has a curved portion and extends downward and rearward, and wherein the secondary exhaust pipe portion is connected to said primary exhaust pipe portion via a flexible tube, extends rearward and includes a catalytic converter, said vibration absorbing apparatus comprising:

a spherical joint disposed between the downstream end of said exhaust manifold and an upstream end of said primary exhaust pipe portion, said spherical joint being located close to said engine; and a resilient support member provided with said secondary exhaust pipe portion for supporting said exhaust pipe relative to the vehicle body;

wherein said resilient support member is disposed upstream of said catalytic converter, and said resilient support member is disposed downstream of said flexible tube; and said resilient support member comprising a support plate secured to said vehicle body, a resilient damper block supported on said support plate and having a rod-insertion hole, and a rod inserted into the rod-insertion hole and fixed relative to said secondary exhaust pipe portion, said rod being fixed to a connecting portion between said flexible tube and said secondary exhaust pipe portion.

2. The vibration absorbing apparatus according to claim 1, wherein said spherical joint comprises:

a first connecting flange provided at the downstream end of said exhaust manifold;

a second connecting flange provided at the upstream end of said primary exhaust pipe portion;

a gasket being air-tightly held between said first and second connecting flanges and having an exhaust gas passage.

3. The vibration absorbing apparatus according to claim 2, said spherical joint further comprises:

one or more bolts and corresponding nuts and springs for coupling said first connecting flange and said second connecting flange in a springing fashion.

4. The vibration absorbing apparatus according to claim 3, wherein said gasket further comprises a spherical portion surrounding said exhaust gas passage, and said second connecting flange comprises a spherical seat that is in slidable contact with the spherical portion.

5. The vibration absorbing apparatus according to claim 4, wherein at least one or said first connecting flange and said second connecting flange is provided with a stay that is secured relative to the rear side of said engine.

6. The vibration absorbing apparatus according to claim 3, wherein at least one of said first connecting flange and said second connecting flange is provided with a stay that is secured relative to the rear side of said engine.

7. The vibration absorbing apparatus according to claim 2, wherein said gasket further comprises a spherical portion surrounding said exhaust gas passage, and said second connecting flange comprises a spherical seat that is in slidable contact with the spherical portion.

8. The vibration absorbing apparatus according to claim 7, wherein at least one of said first connecting flange and said second connecting flange is provided with a stay that is secured relative to the rear side of said engine.

9. The vibration absorbing apparatus according to claim 2, wherein at least one of said first connecting flange and said second connecting flange is provided with a stay that is secured relative to the rear side of said engine.

10. The vibration absorbing apparatus according to claim 1, wherein said spherical joint is located close to a rolling axis of said engine such that rolling displacements of the engine about said rolling axis are substantially absorbed by said spherical joint.

11. The vibration absorbing apparatus according to claim 1, wherein said primary and secondary exhaust pipe portions of said exhaust pipe are rigid and non-flexible.

12. The vibration absorbing apparatus according to claim 1, wherein a length of said flexible tube is substantially less than a length of said catalytic converter.

13. The vibration absorbing apparatus according to claim 1, wherein a length of said flexible tube is less than half than that of said catalytic converter.

14. The vibration absorbing apparatus according to claim 1, wherein said rod extends substantially parallel to an axis of said flexible tube.

15. The vibration absorbing apparatus according to claim 14, wherein said resilient damper block is disposed adjacent an intermediate portion of said flexible tube.

16. A vibration absorbing apparatus for an exhaust system of an engine arranged transversely in a vehicle body, wherein said exhaust system includes, an exhaust manifold extending downwardly relative to the engine and connected to exhaust ports opened in a rear side of said engine, and an exhaust pipe connected to said exhaust manifold, and comprising a primary exhaust pipe portion and a secondary exhaust pipe portion, wherein the primary exhaust pipe portion is connected to a downstream end of said exhaust manifold, has a curved portion and extends downward and rearward, and wherein the secondary exhaust pipe portion is connected to said primary exhaust pipe portion and extends rearward, said vibration absorbing apparatus comprising:

a spherical joint disposed between the downstream end of said exhaust manifold and an upstream end of said primary exhaust pipe portion, said spherical joint being located close to said engine;

a resilient support member provided with said secondary exhaust pipe portion for supporting said exhaust pipe relative to the vehicle body; and a flexible tube disposed between a downstream end of said primary exhaust pipe portion and an upstream end of said secondary exhaust pipe portion, and also disposed upstream of said resilient support member, a length of the flexible tube being less that a width of the catalytic converter at a widest point thereof; and said resilient support member comprising a support plate secured to said vehicle body, a resilient damper block supported on said support plate and having a rod-insertion hole, and a rod inserted into the rod-insertion hole and fixed relative to said secondary exhaust pipe portion, said rod being fixed to a connecting portion between said flexible tube and said secondary exhaust pipe portion.

17. The vibration absorbing apparatus according to claim 16, wherein said rod extends substantially parallel to an axis of said flexible tube.

18. The vibration absorbing apparatus according to claim 17, wherein said resilient damper block is disposed adjacent an intermediate portion of said flexible tube.

* * * * *